US006475007B2

(12) United States Patent
Sugata

(10) Patent No.: US 6,475,007 B2
(45) Date of Patent: Nov. 5, 2002

(54) CABLE REEL

(75) Inventor: Shoichi Sugata, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/908,937

(22) Filed: Jul. 20, 2001

(65) Prior Publication Data

US 2002/0039850 A1 Apr. 4, 2002

(30) Foreign Application Priority Data

Jul. 21, 2000 (JP) ..... 2000-220166

(51) Int. Cl.[7] ..... H01R 35/04
(52) U.S. Cl. ..... 439/164
(58) Field of Search ..... 439/164, 15

(56) References Cited

U.S. PATENT DOCUMENTS 5,827,081 A 10/1998 Sakamaki ..... 439/164
5,833,476 A * 11/1998 Sakamaki ..... 439/164
5,951,311 A * 9/1999 Kato et al. ..... 439/164
5,993,228 A * 11/1999 Kubota ..... 439/164
6,007,355 A * 12/1999 Shibata et al. ..... 439/15
6,042,405 A 3/2000 Masuda et al. ..... 439/15

FOREIGN PATENT DOCUMENTS

JP 08096913 4/1996

* cited by examiner

*Primary Examiner*—Gary F. Paumen
(74) *Attorney, Agent, or Firm*—Greenblum & Bernstein, P.L.C.

(57) ABSTRACT

A rotor interlocked with a steering wheel is rotatably connected with a stator fastened to a steering column, a flat cable is provided in a coiled position in an annular hollow space formed by the stator and a rotor, and an inner peripheral end of the flat cable is electrically connected with an external cable through a connector which is provided in and projects from the rotor. On the upper wall of the rotor, which forms an inner cylinder and an upper wall of the annular hollow space, a bus bar is connected with each conductor on the inner peripheral end of the flat cable and is scored to the rotor with an insert mold, and each conductor of the flat cable and an external cable are welded to the bus bar.

13 Claims, 10 Drawing Sheets

CABLE REEL

BACKGROUND OF THE INVENTION

1. Field of the Invention

The present invention relates to a cable reel mounted on a steering apparatus of automobiles, and more particularly, it relates to an improvement in the connecting configuration between a flat cable accommodated in an annular hollow space formed between a stator and a rotor of a cable reel and an external wire connected with the rotor side.

2. Description of Background Information

As shown in FIG. 9, a conventional cable reel 51 includes a stator 52 including an outer peripheral wall 52*a* and a bottom wall 52*b* fastened to a steering column and a rotor 53 including an inner peripheral wall 53*a* and an upper wall 53*b* fastened to a steering wheel (handle). The stator 52 and rotor 53 are connected for relative rotation. A flexible flat cable 55, which is accommodated in a coiled manner in an annular recess 54 between the stator 52 and the rotor 53, is unwound and rewound in accordance with reciprocal rotation of the rotor 53 in conjunction with rotational movement of the steering wheel (hereinafter abbreviated as wheel).

With the aforementioned cable reel 51, a conductor 56 of flat cable 55 is connected with a wire 58 of a wire harness on a rotor side through an inner peripheral end 56*a* at an end of the coil, while an outer peripheral end 56*b* of a conductor 56 of flat cable 55 is also electrically connected with a wire harness on a stator side through the cable reel 51. Thus, electric devices, such as a turn signal indicator, etc. are electrically connected with a circuit on a car body side.

In the case of the conventional cable reel 51 previously adopted, a bus bar 57 disposed on a rotor 53 side is fastened to a base 61*a* of case 61 as shown in FIG. 10. A conductor 56 of flat cable 55 is welded to one end of the bus bar, and exposed core wires from wire ends are welded to the other end of the bus bar, and a cover 61*b* is provided thereto after welding. The case 61 is fastened by inter-fitting into a recess 53*c* provided at an inner peripheral position of the upper wall 53*b* of rotor 53.

The connecting structure between the flat cable and a wire at the conventional cable reel 51, however, requires a base 61*a* and a cover 61*b* hat cover the bus bar as well as a case receiving recess on a rotor side, which unavoidably leads to an increase in the number of components and assembly processes. In addition, due to the complicated mounting structure around the bus bar 57, there appear such problems as difficulty in correctly positioning the flat cable 55 and the dimension in an axial direction of rotor 53 becoming larger in height due to the dimensional tolerance that accumulates in a disposed position of the flat cable 55.

In addition, with an increase in the number of circuits, in the case of a connecting area located between external wires and a flat cable that requires two positions must be provided, a case 61 becomes necessary which covers a bus bar connecting a flat cable and a wire for every connection, thereby causing problems in increasing the number of components as well as the assembly processes.

Furthermore, because the interfitted area between the rotor and the stator is the center of coiling of the cable, the length of the flat cable must be greater in order to accommodate the necessary number of steering wheel rotations. Although it is preferable to maintain the length at a minimum, there is a problem that the length of the flat cable inherently becomes larger and at least occupies a protrusive space of the case at the connecting areas.

SUMMARY OF THE INVENTION

The present invention was developed to solve the above problems. Therefore a purpose of the present invention is to attain electric connection between a flat cable and an external cable through a bus bar without using a different case, thereby reducing the number of components and assembling processes.

According to an aspect of the present invention, a cable reel is provided including a rotor interlocked with a steering wheel and rotatably connected with a stator provided on a steering column, a flat cable is provided in a coiled manner in an annular hollow space provided by the stator and rotor, and an inner peripheral end of the flat cable is electrically connected with an external cable through a connector which extends from the rotor. Additionally, an upper wall of the rotor forms an inner cylinder and an upper wall of the annular hollow space, a bus bar is connected with each conductor on the inner peripheral end side of the flat cable and is secured to the upper wall of the rotor with an insert mold, and the conductors of the flat cable and an external cable are welded to the bus bar.

According to a further aspect of the present invention, because the bus bar functions as an electric relay electrically connecting the inside and outside of the cable reel and is insert molded on the upper wall of the rotor, a mounting case is unnecessary. A mounting process also becomes unnecessary because the bus bar is mounted at the same time that the rotor is molded. Further, a mounting base is unnecessary since the bus bar is provided parallel to the upper wall surface of the rotor. That is, the upper wall of the rotor is utilized as a base substrate of the bus bar to reduce the required space of the cable reel.

In another aspect of the present invention, a mounting structure is made simpler, reducing the number of components, assembling processes, and production facilities. Furthermore, because the bus bar is mounted directly on the rotor, the flat cable can be mounted in an accurate position without causing accumulation of dimensional tolerances at the disposed position of the flat cable, thereby making it possible to set a dimension (in height) in an axial direction of the rotor smaller by an amount equivalent to the space that would be required for a mounting case or the like.

In a further aspect of the present invention, a cable reel is provided including an opening is provided on an upper wall of the rotor, which allows a connecting area of the bus bar to be exposed, and a through slit for a flat cable is provided at an inner peripheral end of the opening. An inner peripheral end area of the flat cable is pulled out through the through slit from the annular hollow space and is arranged on the upper face of the bus bar, and conductors of the flat cable and the bus bar are welded from above and below using a welding horn and a welding anvil.

According to another aspect of the present invention, a bus bar that is molded onto the rotor, and a flat cable can be welded together by a welding horn and a welding anvil. In addition, because the bus bar and the flat cable are connected in the area of the starting point for coiling the flat cable, a spare length becomes unnecessary for connecting the bus bar with the flat cable. Furthermore, a connector area projects from the upper wall of the rotor, and a connecting area of the bus bar is exposed through the opening of a bottom area of the connector area. An L-type terminal connected with an external wire terminal is inserted into the connector area, the lower face of the L-type terminal is positioned on the upper face of the bus bar, and the bus bar and the L-type terminal are connected by welding using the welding horn and the welding anvil. Further, by connecting a C-type terminal with the cable terminal, the L-type terminal and the bus bar that is molded in a horizontal position in the rotor are welded by a welding horn and a welding anvil.

According to a further aspect of the invention, the welding area of the conductors of the bus bar and the flat cable, and the welding area of the bus bar and the wire side, are positioned at the same radial distance from the center of the rotor, or circular periphery of the rotor, and welding connection is performed by rotating the rotor relative to a welding horn and a welding anvil. Further, the welding connection between the bus bar and the flat cable and the welding connection between the bus bar and the cable terminal can be performed in succession by rotating the rotor under conditions in which a welding horn of a welding machine that extends from the peripheral edge direction of the upper wall of the rotor and a welding anvil are held at a predetermined position, thereby making the welding work higher in efficiency. Particularly, when there are many welding points required, the present invention exhibits remarkable efficiency in welding work.

According to another aspect of the present invention, an ultrasonic welding machine or a resistance welding machine is normally used for the welding.

According to a further aspect of the present invention, a structure which connects an outer peripheral end of the flat cable and a cable of the body side also includes the same structure as that described above, and, by molding the bus bar on the base surface of the stator, the outer peripheral end of the flat cable and a cable wired to the automobile body side may be weld connected to the bus bar. Furthermore, the stator side may be fastened as usual in an engaged manner to an engaging area provided on the stator by connecting the flat cable that is molded to a different body case and a cable.

In a further aspect of the present invention, a cable reel is provided including a stator and a rotor rotatably connected to the stator, a flat cable is provided in a coiled condition in an annular hollow space formed by the stator and the rotor, the flat cable has an inner peripheral end electrically connected with an external cable through a connector extending from the rotor, an upper wall of the rotor forms an upper wall of the annular hollow space, a bus bar is connected with each conductor on the inner peripheral end of the flat cable and secured to the upper wall of the rotor within an insert mold, and the conductors of the flat cable and an external cable are welded to the bus bar.

According to another aspect of the present invention, a method of making a cable reel is provided, the method including providing a rotor rotatably connected to a stator, the rotor and the stator forming an annular hollow space, and an upper wall of the rotor forming an upper wall of the annular hollow space, providing a flat cable in a coiled condition in the annular hollow space formed by the stator and the rotor, the flat cable having an inner peripheral end, insert molding a bus bar to the upper wall of the rotor, and welding the bus bar to each conductor on the inner peripheral end of the flat cable. The present invention may further include connecting an external cable to the bus bar by welding.

According a further aspect of the present invention, a method of making a cable reel is provided including providing an opening on the upper wall of the rotor, the opening allowing a connecting area of the bus bar to be exposed, providing a through slit for the flat cable adjacent an inner peripheral end of the opening, pulling the inner peripheral end of the flat cable out through the through slit from the annular hollow space and positioning the inner peripheral end of the flat cable on an upper face of the bus bar, and welding the conductors of the flat cable and bus bar together using a welding horn and a welding anvil.

In another aspect of the present invention, a method of making a cable reel is provided including providing a connector area that projects from the upper wall of the rotor so that a connecting area of the bus bar is exposed through an opening of a bottom area of the connector area, providing an L-type terminal connected with an external wire terminal that is inserted into the connector area, wherein a lower face of the L-type terminal is positioned on an upper face of the bus bar, and connecting the bus bar and the L-type terminal by welding using a welding horn and a welding anvil. The present invention may further include a method including positioning a welding area of the conductors of the flat cable and the bus bar, and a welding area of the bus bar and an external cable, on a same radius of the rotor, and rotating the rotor to position a welding horn and a welding anvil of a welding machine to perform the welding.

DETAILED DESCRIPTION OF THE PREFERRED EMBODIMENTS

Figure 1:
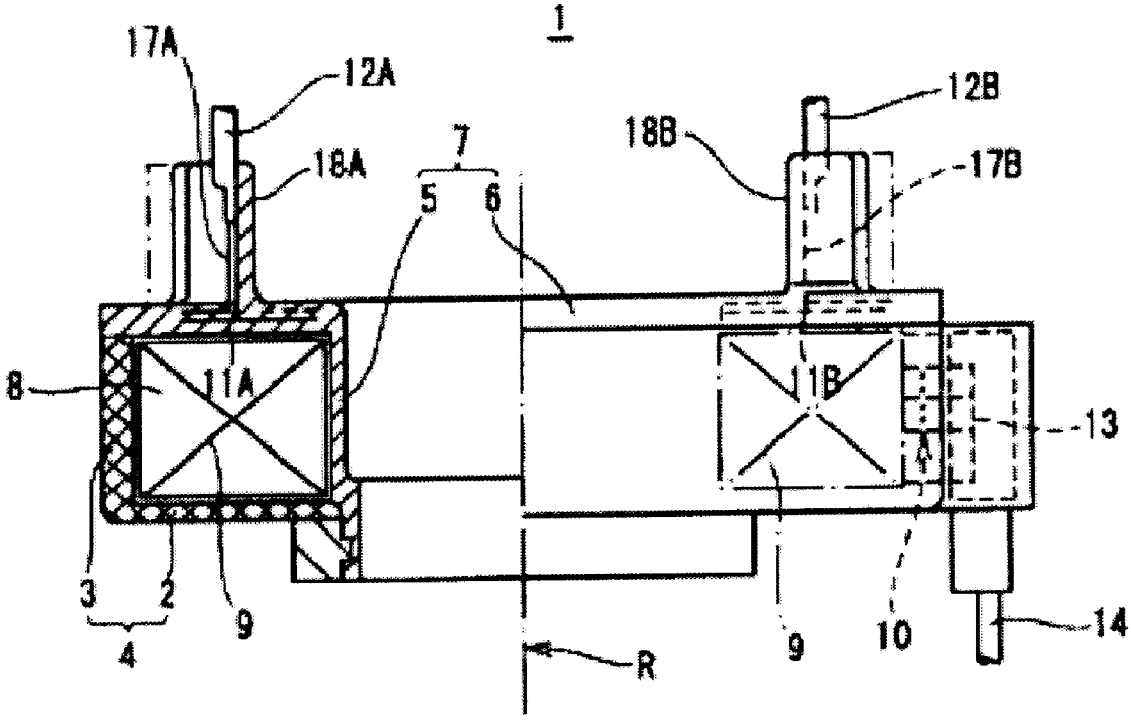
FIG. 1 is a front elevation view showing a cross sectional view of the left half of the integral structure of the cable reel of the embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

A more detailed description of an embodiment of the present invention shown in the drawings is discussed below.

Figure 2:
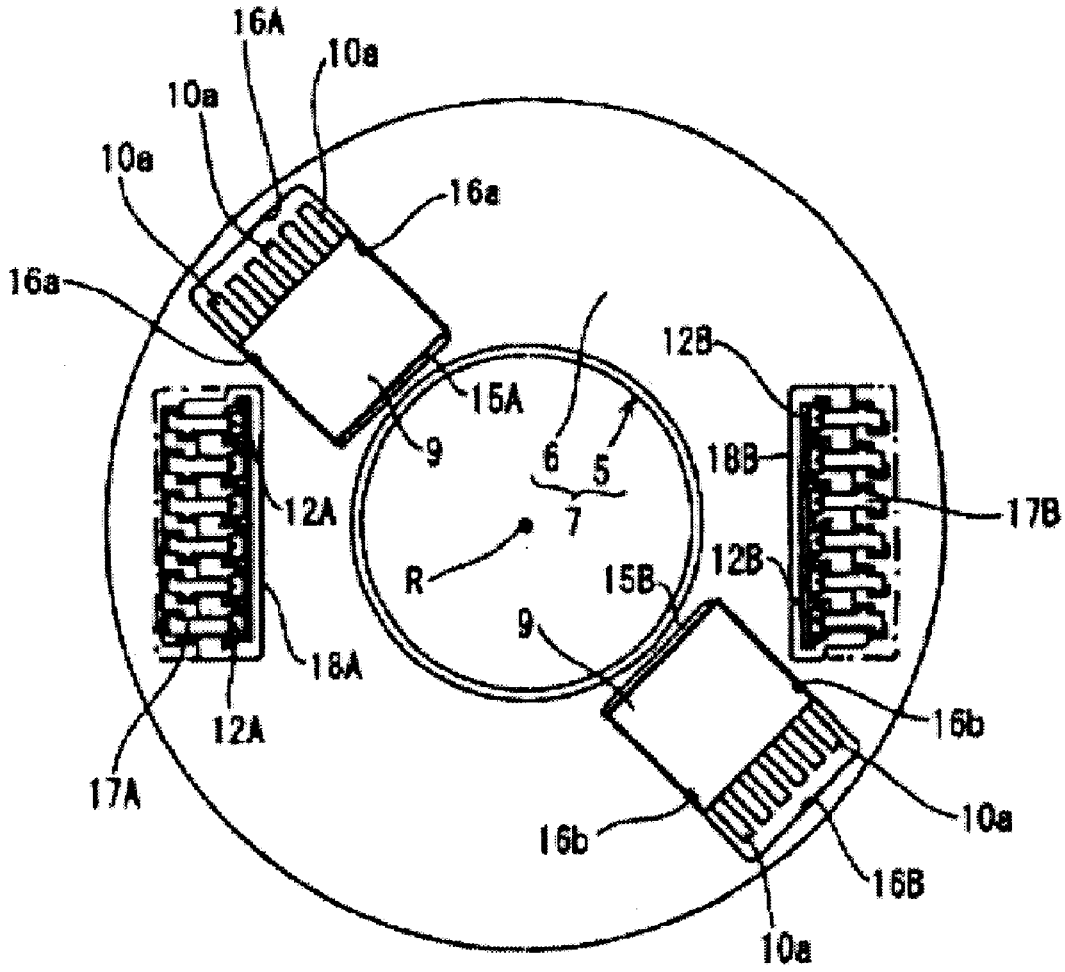
FIG. 2 is a plan view showing the cable reel of the embodiment of FIG. 1.

As shown in FIGS. 1 and 2, a cable reel 1 has a construction in which a stator 4 made, for example, of synthetic resin, which forms an external peripheral wall 3 and a bottom wall 2 is fastened to a steering column. A rotor 7 made, for example, of a synthetic resin, which forms an inner peripheral wall 5 and an upper wall 6 is fastened to a steering wheel. The stator and rotor are connected with each other in a relatively rotatable manner. A flexible flat cable 9 is accommodated in a coiled condition in an annular hollow area between a stator 4 and rotor 7, and is wound out and rewound in accordance with reciprocal rotation during rotation of the steering wheel.

Figure 3:
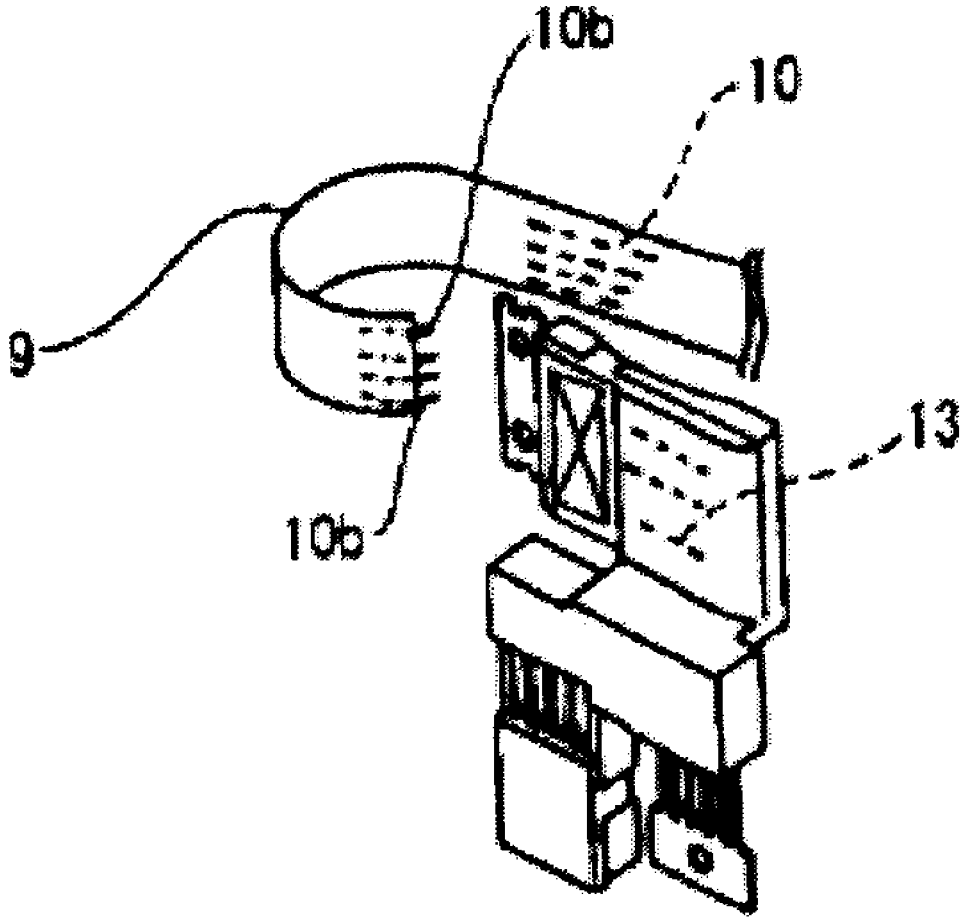
FIG. 3 is a perspective view showing a connecting condition of an end of a conductive flat cable displaced to the outside in the embodiment of FIG. 1.

In an embodiment of the present invention, the cable reel 1 may accommodate two flat cables 9. An inner peripheral end 10*a* on each of the conductors 10 in the two flat cables 9 is electrically connected with one of cables 12A and 12B of a wire harness on a steering wheel side through one of bus bars 11A, 11B. Further, as shown in FIG. 3, an outer peripheral end 10*b* of each of the conductors 10 of flat cables 9 is electrically connected with a cable 14 of a wire harness on a steering column side through the bus bar 13. The stator 4 may include two bus bars 13 to accommodate two cables 9.

The bus bars 11A and 11B positioned between the cables 12A and 12B, respectively, and cables 9 on a steering wheel side are insert molded in parallel to the upper wall 6 of rotor 7. That is, by positioning the bus bars 11A and 11B on the inside of a mold for rotor molding, the bus bars 11A and 11B are mounted to the upper wall 6 of the rotor 7 by insert molding as the rotor 7 is formed by resin molding.

The aforementioned bus bars 11A and 11B include exposed connecting areas 11A*a* and 11B*a* at openings 16A and 16B (note FIG. 4), respectively, provided on the upper wall surface of rotor 7. On the back surface side of rotor 7, welding holes 20A and 20B are provided below the connecting areas 11A*a* and 11B*a*, respectively. In this case, the openings 16A and 16B are provided with covers (not shown in the drawings) after welding the flat cables 9 and bus bars 11A and 11B.

Figure 4:
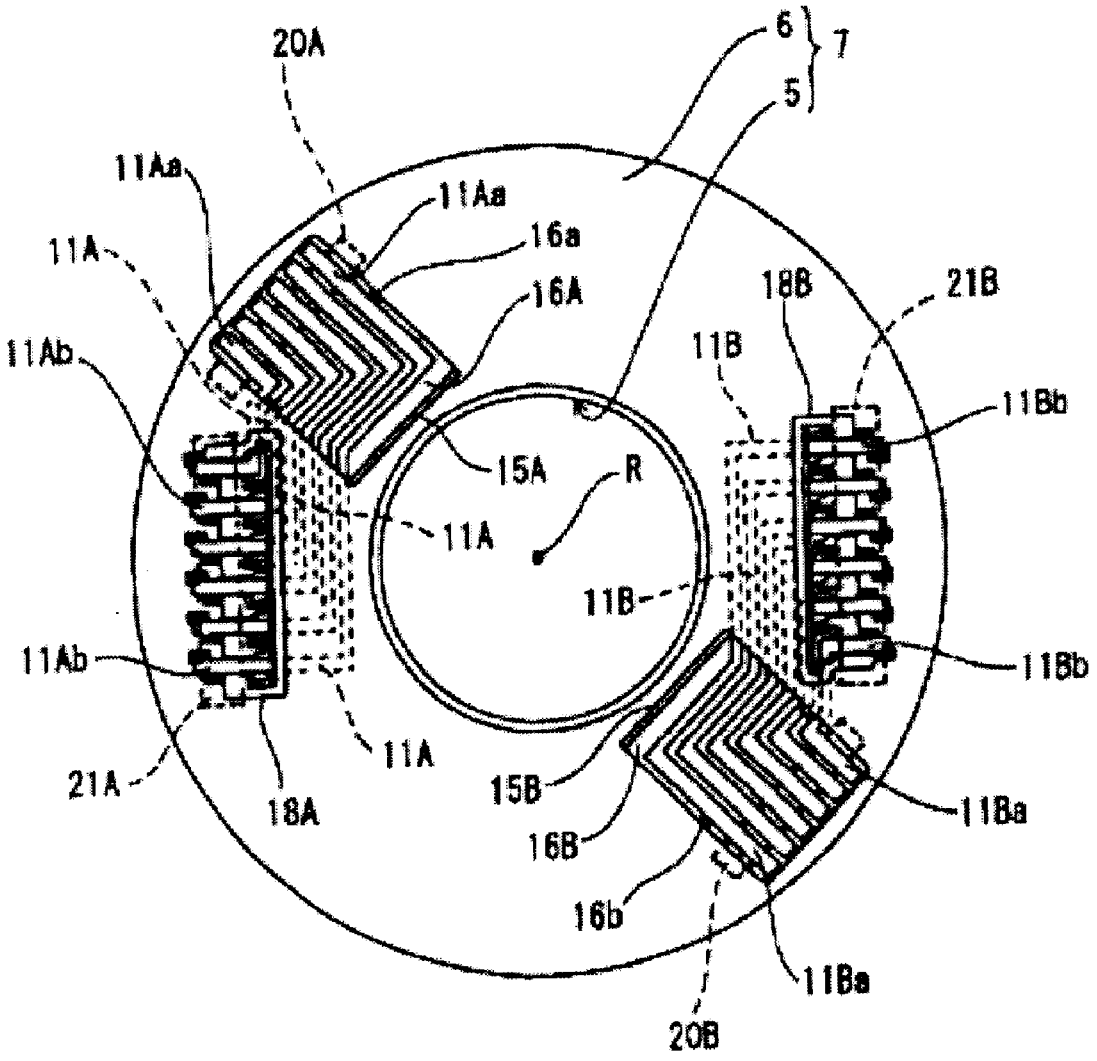
FIG. 4 is a top plan view showing an insertion condition of the bus bars of a rotor in the embodiment of FIG. 1.
Figure 5:
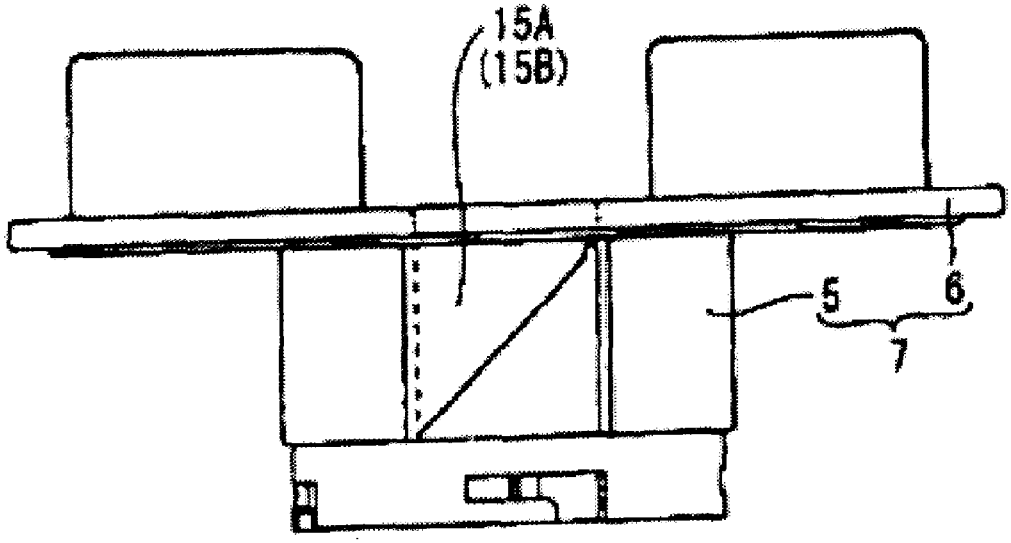
FIG. 5 is a front elevation view showing a rotor in accordance with the embodiment of FIG. 1.

On the inner peripheral ends of the aforementioned openings 16A and 16B, as shown in FIGS. 4 and 5, the slits 15A and 15B are made by through-forming and enable the flat cables 9 to be fed therethrough.

As shown in FIG. 5, the slits 15A and 15B extend from the inner side of rotor 7 to the outer side along the inner peripheral wall 5, and the inner opening is formed in such a manner that the inner opening gradually rises obliquely at a 45° angle to a horizontal. As shown with a dashed line in FIG. 5, an area at the inner peripheral end of each flat cable 9 is folded by 45°, and a tip of the folded portion is drawn above the upper wall 6 as shown in FIG. 2 through one of slits 15A and 15B and is folded and positioned on the upper face of one of bus bars 11A and 11B of the openings 16A and 16B.

Figure 6:
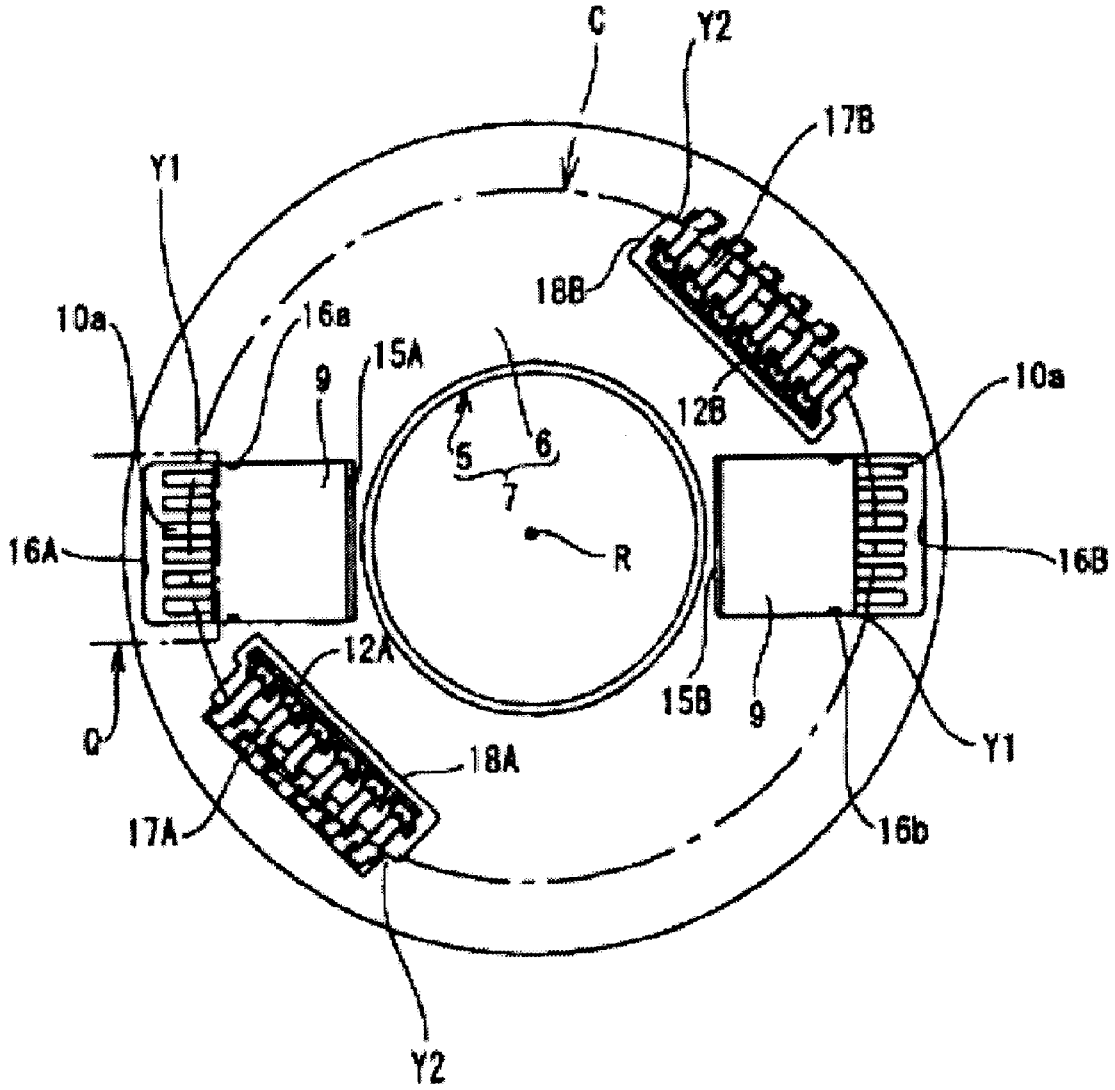
FIG. 6 is a top plan view depicting the welding condition of the rotor.

As shown in FIGS. 2 and 6, ribs 16*a* and 16*b* are provided on both sides, in a width direction, of openings 16A and 16B, and the ribs 16*a* and 16*b* are constructed so that both sides of the flat cables 9 are held with pressure from above.

Figure 7:
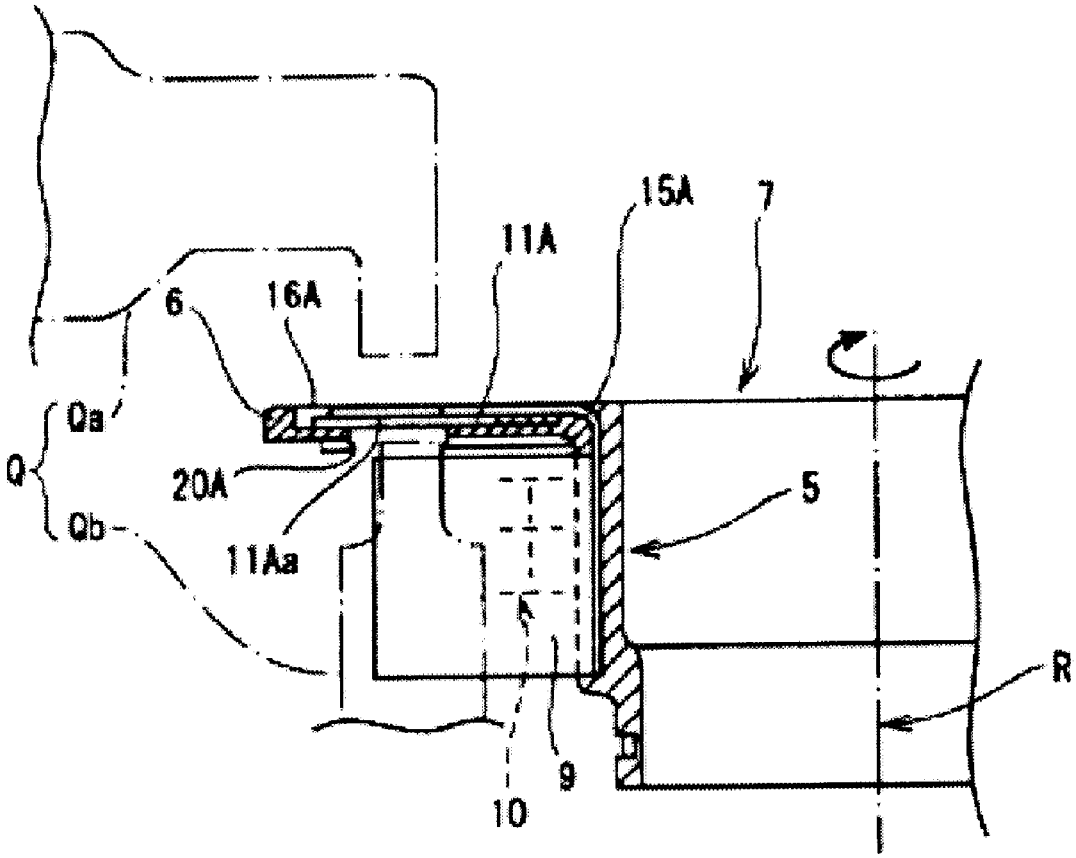
FIG. 7 is a diagrammatic view depicting welding of a flat cable and a bus bar.

As described above, the connection of a conductor 10 of a flat cable 9 which is mounted on the upper face of connecting areas 11A*a* and 11B*a* of bus bars 11A and 11B which are insert molded onto the rotor 7 may be performed, for example, by ultrasonic welding. A welding horn Qa may be lowered from above by positioning the welding holes 20A and 20B on a welding anvil Qb of the ultrasonic welding machine Q as shown in FIG. 7.

The bus bars 11A and 11B, insert molded on the upper wall 6 of the rotor 7, extend to positions of the bottom face openings 21A and 21B of connector areas 18A and 18B which extend from the upper wall 6. On these connecting areas 18A and 18B, L-type terminals 17A and 17B connected with the terminals of cables 12A and 12B, are insertedly engaged, and the horizontal lower face of the L-type terminal 17A and 17B may be disposed on the upper face of connecting areas 11A*b* and 11B through slits on the bus bars 11A and 11B.

Figure 8:
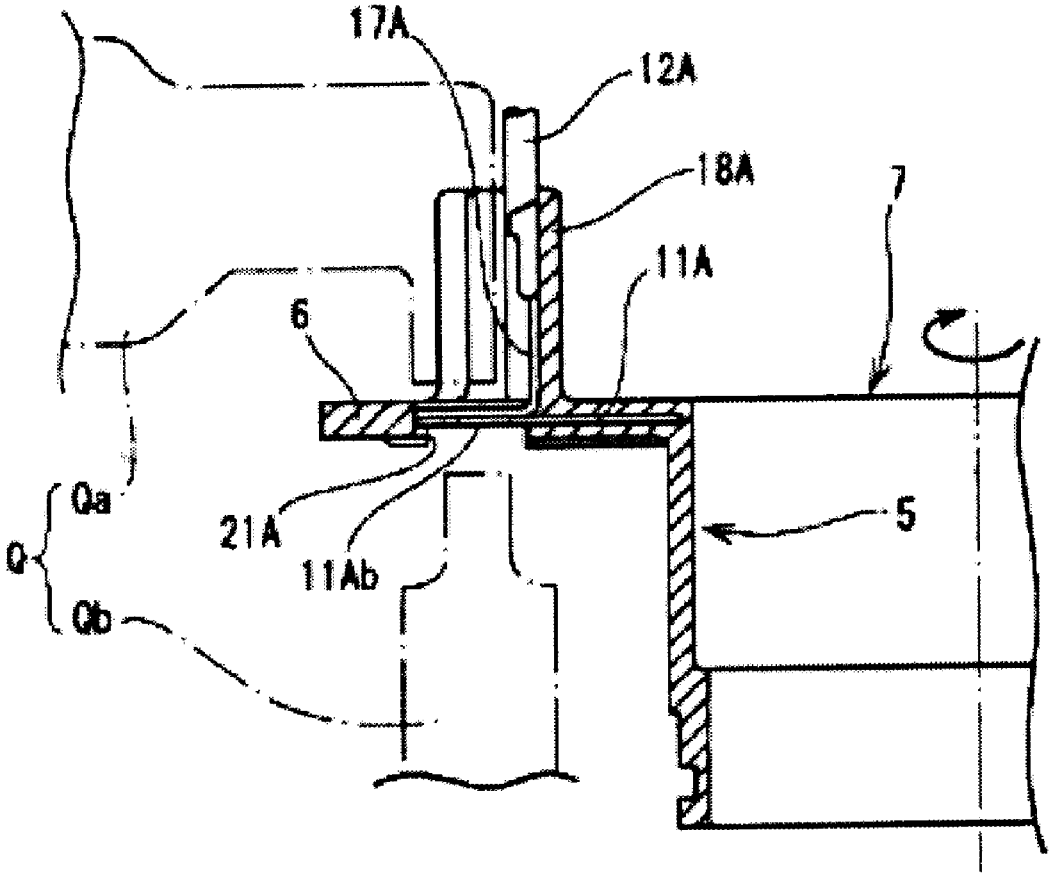
FIG. 8 is a diagrammatic view depicting welding of a cable and a bus bar of wire harness.
Figure 9:
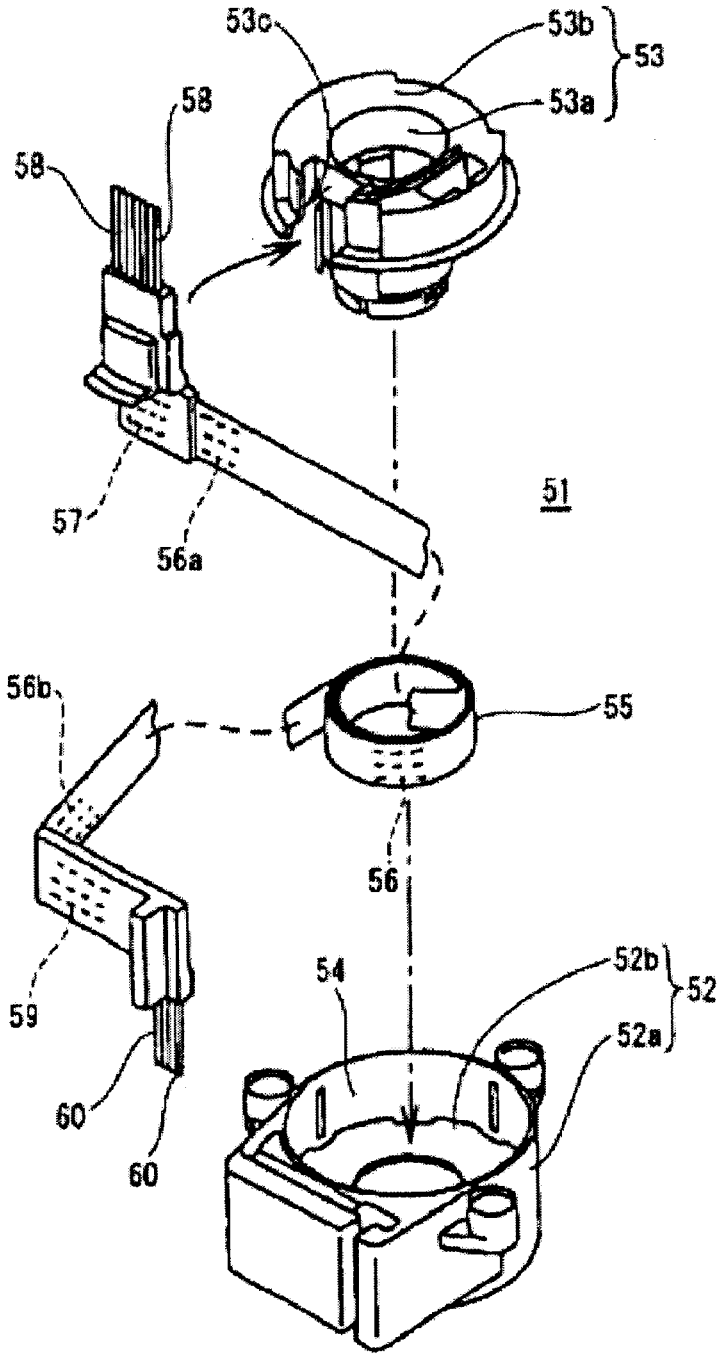
FIG. 9 is an exploded perspective view showing a construction of a conventional cable reel.
Figure 10:
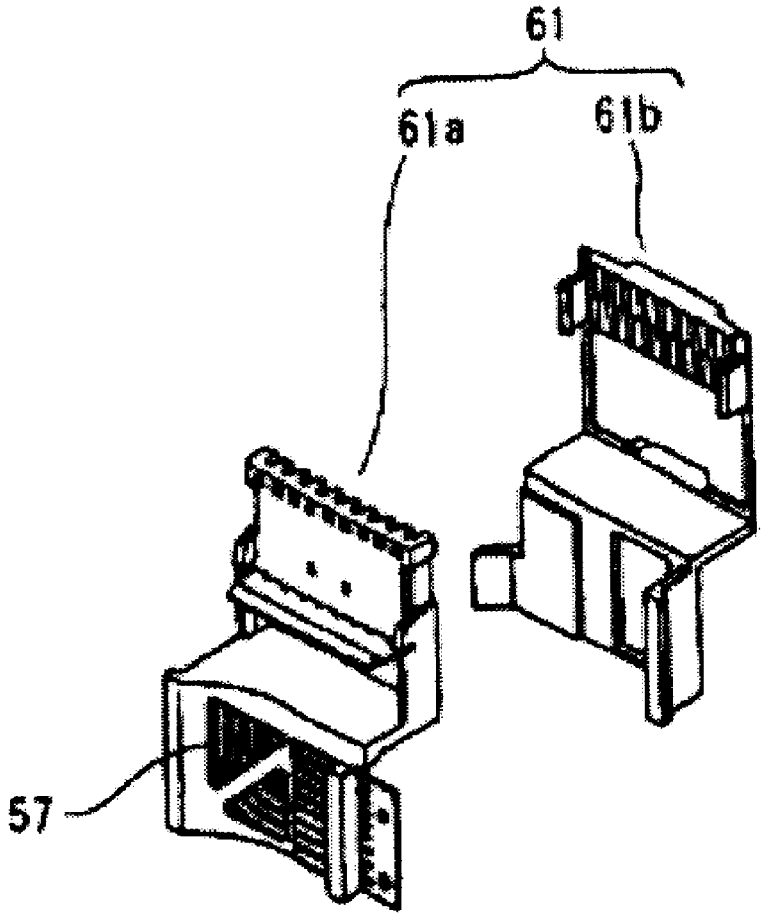
FIG. 10 is an exploded perspective view showing a structure around the bus bar of the conventional cable reel.

Under the condition shown in FIG. 8, the ultrasonic welding is performed for connecting L-type terminals 17A and 17B with the bus bars 11A*b* and 11B*b*, respectively, by positioning a welding anvil Qb of the ultrasonic welding machine Q in the positions of the bottom lower face of connecting areas 18A and 18B followed by lowering the welding horn Qa from above. In this case, without connecting the L-type terminals with the terminals of cables 12A and 12B, the ultrasonic welding may be performed by positioning on the connecting areas 11A*a* and 11B*b* of the bus bar, with the core wires exposed from the terminal of cables 12A and 12B.

A welded connection is formed in such a manner that, as shown in FIG. 6, a welding area Y1 of connecting areas 11A*a* and 11B*a* of the bus bar and a conductor 10 of a flat cable 9, and a welding area Y2 of connecting area 11A*b* and 11B*b* of the bus bar and L-type terminals 17A and 17B, are positioned on the same circumference, or radial distance from the center, of the rotor 7. Thus, by rotating the rotor 7, a welding horn Qb and a welding anvil Qa of ultrasonic welding machine Q may be repositioned from welding area Y1 to welding area Y2.

In this way, connection by ultrasonic welding may be established by combining bus bars, 11A and 11B, and a conductor 10 of the flat cable 9; and bus bars, 11A and 11B, and cables 12A and 12B, respectively. In addition, because the welding is performed by pinching the upper wall 6 of the rotor 7, welding work can be carried out in a stable manner that is easy to perform.

As described above, since the bus bars 11A and 11B that electrically connect a flat cable 9 inside the cable reel 1 with the cable 12 are insert molded to the upper wall 6 of the rotor 7, a mounting case or the like becomes unnecessary. A mounting process also becomes unnecessary because the bus bars 11A and 11B are insert molded at the same time that the rotor 7 is formed. In addition, because the bus bars 11A and 11B are insert molded into the upper wall of the rotor, a space for mounting the bus bars becomes simple, and thus requires fewer components, fewer assembly processes, and fewer production facilities. Furthermore, since bus bars 11A and 11B are mounted directly to a rotor, no accumulation of dimensional tolerance of the position of the flat cable 9 is made; flat cable 9 can be mounted in an accurate position. In addition, it is also possible to make a dimension (in height) of rotor 7 smaller in an axial direction by the amount of space that would have been occupied by a mounting case or the like.

In addition, with the mounting case or the like unnecessary, the distance to the outer diameter of a flat cable 9 from the center of the core resulting from the space saving due to elimination of the case, a smaller diameter of flat cable equivalent to such space saving can be employed, thereby making a reduction in length of flat cable 9 possible.

As shown in FIG. 5, slits 15A and 15B through which flat cables 9 are fed at a coiling start position of the flat cable 9 on the upper wall 6 on rotor 7 are made by through forming, connecting areas 11A*a* and 11B*b* of flat cable 9 at bus bars 11A and 11B are exposed, and the inner peripheral ends 10*a* of conductors 10 of the flat cables 9 which are drawn to the opening of the upper wall 6 through the slits 15A and 15B are connected with the connecting areas 11A*a* and 11B*b* of bus bars 11A and 11B.

Thus, since the bus bars 11A and 11B are connected with the inner peripheral ends 10*a* of the conductors 10 of flat cables 9 at a position near the coiling start point of the flat cables 9, the length of the flat cables 9 can be shortened.

In addition, as mentioned above, the welding area Y1 between the bus bars 11A and 11B and the conductors 10 of flat cables 9, and the welding area Y2 between the bus bars 11A and 11B and cables 12A and 12B are, as shown in FIG. 6, positioned on the same circumference centering on a point of a rotational axis R of the cable reel 1 as shown. Therefore, by setting a working position of the welding machine Q extending from the upper wall 6 on the rotor 7 to the circumference of circle C, and relatively rotating the welding machine Q and rotor 7, with the rotating axis R of cable reel 1 taken as a rotating axis, each connecting position will come to the welding position of welding machine Q, thereby making efficient welding possible. Greater efficiency can be achieved when a number of welding positions are available.

As is clear from the description above, according to the cable reel of the present invention, since a bus bar which connects a flat cable inside the cable reel and a cable is insert molded onto the upper wall of the rotor, a mounting case or the like becomes unnecessary and the bus bar is mounted by molding at the same time of rotor molding. Further, the mounting process also becomes unnecessary. In addition, since the bus bar is inserted into the upper wall of rotor, the mounting space for the bus bar becomes unnecessary. Therefore, the mounting structure is simplified and the number of components, assembling processes, and production facilities becomes fewer.

In addition, since the bus bars are to be directly mounted on the rotor, accumulation of dimensional tolerance at a position on the flat cable does not occur. In addition, the flat cable can be mounted in an accurate position, and it is also possible to reduce the dimension (in height) in an axial direction of inner cylindrical members by an amount equivalent to that which would have been occupied by a mounting case.

Furthermore, in line with the mounting case becoming unnecessary, displacement can be eliminated to the outside of the coiling start point of the flat cable which results from the saving of space equivalent to the mounting case size, thereby a smaller diameter of flat cable and shorter length of flat cable can be utilized, consequently leading to reduction in electric resistance of the conductor line.

In addition, carrying out the connection by use of a welding joint between a bus bar and a flat cable, or between a bus bar and a cable, each welding can be firmly performed at a stretch, thereby enhancing the productivity and reliability.

Furthermore, when all the connecting areas between a bus bar and a flat cable and a connecting area between a bus bar and a cable are positioned on the circumference of a circle set on the plane centering on the point above the rotating shaft of the cable reel, each connecting area can be welded in succession by shifting a working position of the welding machine, which enables welding to be efficiently carried out with improved productivity.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2000-220166, filed on Jul. 21, 2000, which is herein expressly incorporated by reference in its entirety.

What is claimed is:

1. A cable reel comprising:

a rotor interlocked with a steering wheel and rotatably connected to a stator provided on a steering column, a flat cable provided in a coiled condition in an annular hollow space formed by said stator and said rotor, said flat cable having an inner peripheral end electrically connected with an external cable through a connector extending from said rotor; and an upper wall of said rotor forming an upper wall of said annular hollow space, a bus bar connected with each conductor on said inner peripheral end of said flat cable and secured to said upper wall of said rotor within an insert mold, and said conductors of said flat cable and an external cable being welded to said bus bar.

2. The cable reel as set forth in claim 1, wherein;

an opening is provided on said upper wall of said rotor, said opening allowing a connecting area of said bus bar to be exposed;

a through slit for said flat cable is provided adjacent an inner peripheral end of said opening; and said inner peripheral end of said flat cable may be pulled out through said through slit from said annular hollow space and positioned on an upper face of said bus bar, and said connectors of said flat cable and said bus bar are welded together using a welding horn and a welding anvil.

3. The cable reel as set forth in claim 1, wherein;

a connector area projects from said upper wall of said rotor, a connecting area of said bus bar is exposed through an opening of a bottom area of said connector area; and an L-type terminal connected with an external wire terminal is insertable into said connector area, a lower face of said L-type terminal is positioned on an upper face of said bus bar, and said bus bar and said L-type terminal are connected by welding using a welding horn and a welding anvil.

4. The cable reel as set forth in claim 1, wherein;

a welding area of said conductors of said bus bar and said flat cable, and a welding area of said bus bar and a wire side, are positioned on a same radius of said rotor, and connection by welding is carried out by a welding horn and a welding anvil of a positioned welding machine by rotating said rotor.

5. A cable reel comprising:

a stator;

a rotor rotatably connected to said stator;

a flat cable provided in a coiled condition in an annular hollow space formed by said stator and said rotor, said flat cable having an inner peripheral end electrically connected with an external cable through a connector extending from said rotor; and an upper wall of said rotor forming an upper wall of said annular hollow space, a bus bar connected with each conductor on said inner peripheral end of said flat cable and insert molded to said upper wall of said rotor and said conductors of said flat cable and an external cable being welded to said bus bar.

6. The cable reel as set forth in claim 5, said cable reel further comprising:

an opening provided on said upper wall of said rotor, said opening allowing a connecting area of said bus bar to be exposed; and a through slit for said flat cable provided adjacent an inner peripheral end of said opening, wherein said inner peripheral end of said flat cable may be pulled out through said through slit from said annular hollow space and positioned on an upper face of said bus bar, and said connectors of said flat cable and said bus bar are welded together using a welding horn and a welding anvil.

7. The cable reel as set forth in claim 5, wherein:

a connector area projects from said upper wall of said rotor and a connecting area of said bus bar is exposed through an opening of a bottom area of said connector area; and an L-type terminal connected with an external wire terminal is insertable into said connector area, a lower face of said L-type terminal is positioned on an upper face of said bus bar, and said bus bar and said L-type terminal are connected by welding using a welding horn and a welding anvil.

8. The cable reel as set forth in claim 5, wherein;

a welding area of said conductors of said bus bar and said flat cable, and a welding area of said bus bar and a wire side, are positioned on a same radius of said rotor, and connection by welding is carried out by a welding horn and a welding anvil of a positioned welding machine by rotating said rotor.

9. A method of making a cable reel comprising:

providing a rotor rotatably connected to a stator, said rotor and said stator forming an annular hollow space, and an upper wall of said rotor forming an upper wall of said annular hollow space;

providing a flat cable in a coiled condition in said annular hollow space formed by said stator and said rotor, said flat cable having an inner peripheral end;

insert molding a bus bar to said upper wall of said rotor; and welding said bus bar to each conductor on said inner peripheral end of said flat cable.

10. The method of making a cable reel as set forth in claim 9, further comprising:

connecting an external cable to said bus bar by welding.

11. The method of making a cable reel as set forth in claim 9, further comprising:

providing an opening on said upper wall of said rotor, said opening allowing a connecting area of said bus bar to be exposed;

providing a through slit for said flat cable adjacent an inner peripheral end of said opening;

pulling said inner peripheral end of said flat cable out through said through slit from said annular hollow space and positioning said inner peripheral end of said flat cable on an upper face of said bus bar; and welding said conductors of said flat cable and bus bar together using a welding horn and a welding anvil.

12. The method of making a cable reel as set forth in claim 9, further comprising:

providing a connector area that projects from said upper wall of said rotor so that a connecting area of said bus bar is exposed through an opening of a bottom area of said connector area;

providing an L-type terminal connected with an external wire terminal that is inserted into said connector area, wherein a lower face of said L-type terminal is positioned on an upper face of said bus bar; and connecting said bus bar and said L-type terminal by welding using a welding horn and a welding anvil.

13. The method of making a cable reel as set forth in claim 9, further comprising:

positioning a welding area of said conductors of said flat cable and said bus bar, and a welding area of said bus bar and an external cable, on a same radius of said rotor; and rotating said rotor to position a welding horn and a welding anvil of a welding machine to perform said welding.

* * * * *

UNITED STATES PATENT AND TRADEMARK OFFICE

CERTIFICATE OF CORRECTION

PATENT NO. : 6,475,007 B2
DATED : November 5, 2002
INVENTOR(S) : S. Sugata

It is certified that error appears in the above-identified patent and that said Letters Patent is hereby corrected as shown below:

Column 8,
Line 25, "secured" should be -- insert molded --.
Lines 25-26, delete "within an insert mold".

Signed and Sealed this

Twelfth Day of August, 2003

JAMES E. ROGAN
*Director of the United States Patent and Trademark Office*